US008090297B2

(12) United States Patent
Hano

(10) Patent No.: US 8,090,297 B2
(45) Date of Patent: Jan. 3, 2012

(54) CORONA CHARGER INCLUDING A GRID WITH AN SP3 AND SP2 SURFACE LAYER FORMED THEREON

(75) Inventor: Masami Hano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 284 days.

(21) Appl. No.: 12/428,950

(22) Filed: Apr. 23, 2009

(65) Prior Publication Data

US 2009/0269105 A1 Oct. 29, 2009

(30) Foreign Application Priority Data

Apr. 23, 2008 (JP) ..... 2008-112517

(51) Int. Cl.
*G03G 15/02* (2006.01)

(52) U.S. Cl. ..... 399/171

(58) Field of Classification Search ..... 399/170, 399/171

See application file for complete search history.

(56) References Cited

U.S. PATENT DOCUMENTS

| | | | | |
|---|---|---|---|---|
| 2006/0062596 | A1 | 3/2006 | Deguchi | |
| 2007/0217822 | A1 | 9/2007 | Deguchi | |
| 2008/0076684 | A1 * | 3/2008 | Nanbu et al. | 508/109 |
| 2008/0080896 | A1 * | 4/2008 | Ino et al. | 399/171 |
| 2008/0226334 | A1 * | 9/2008 | Ohno et al. | 399/100 |
| 2009/0116872 | A1 * | 5/2009 | Sugimoto et al. | 399/168 |

FOREIGN PATENT DOCUMENTS

| | | | |
|---|---|---|---|
| JP | 11-040316 | | 2/1999 |
| JP | 2006-113531 | | 4/2006 |
| JP | 2006323366 | A * | 11/2006 |
| JP | 2007-256397 | | 10/2007 |
| JP | 2008233254 | A * | 10/2008 |

* cited by examiner

*Primary Examiner* — David Gray
*Assistant Examiner* — Joseph Wong
(74) *Attorney, Agent, or Firm* — Canon USA Inc IP Division

(57) ABSTRACT

A corona charger includes a charging wire and a plate grid. The plate grid comprises a stainless steel base and a surface layer formed of tetrahedral amorphous carbon on the base.

5 Claims, 10 Drawing Sheets

CORONA CHARGER INCLUDING A GRID WITH AN SP3 AND SP2 SURFACE LAYER FORMED THEREON

BACKGROUND OF THE INVENTION

1. Field of the Invention

The present invention relates to a corona charger used in electrophotographic apparatuses, such as copy machines, printers, and facsimiles, and to an electrophotographic apparatus including the corona charger.

2. Description of the Related Art

A so-called electrophotographic apparatus, which is an image forming apparatus using electrophotography, forms an electrostatic latent image on a surface of an image bearing member (electrophotographic photosensitive member) by charging the surface of the image bearing member and subsequently exposing the image bearing member. In order to charge the surface of the image bearing member, a corona charger, which is a non-contact charging member, is widely used.

A corona charger generally includes a shielding case (supporting enclosure) being open at one side opposing the image bearing member, supporting blocks (holding members) disposed at both ends of the shielding case in the longitudinal direction, and a charging wire (charging line) extending between the supporting blocks. The charging wire is generally made of tungsten or the like.

For charging a surface of an image bearing member with a corona charger, a discharge current is applied to the charging wire with the open side of the shielding case closely opposing the image bearing member, thus generating corona discharge to apply electric charges to the surface of the image bearing member.

The charged potential of the image bearing member is often controlled by adjusting the amount of electric charge applied to the image bearing member by applying a bias voltage a grid disposed between the charging wire and the image bearing member.

The grid may be made of wires of the same material as the charging wire or stainless steel (SUS), or a plate of such a material having a plurality of through-holes formed by etching.

The wire grid is liable to be contaminated with toner or the like. A contaminated grid tends not to sufficiently control the charged potential at the surface of the image bearing member, and the charged potential becomes nonuniform.

On the other hand, the plate grid has a larger area than the wire grid, and can accordingly more easily control the charged potential at the surface of the image bearing member to an appropriate range. In addition, even if the plate grid is contaminated to some extent, the ability to control the charged potential is not degraded more than the wire grid.

Furthermore, a plate grid (base) made of SUS can have high durability, and is accordingly difficult to deform even by long-term use. The ability of the grid to control the charged potential is not changed by the deformation.

Thus, it is expected that the plate grid will control the charged potential at the surface of the image bearing member to a substantially constant value over a long term.

If a corona charger including a plate grid is used under high-temperature, high-humidity conditions, however, nonuniform charging occurs at the surface of the image bearing member in the longitudinal direction of the corona charger. Consequently, a defect, such as unevenness in density, occurs in output images.

This is because the material of the plate grid reacts with a product of corona discharge to produce an insulating metal oxide on the surface of the grid. The insulating metal oxide makes the plate grid partially insulative to reduce the amount of electric charge to the plate grid and increase the amount of electric charge to the image bearing member. Consequently, the surface of the image bearing member has nonuniform charged potentials.

In addition, the product of the corona discharge may clog the through-holes, thereby causing nonuniform charging.

In general, SUS has higher corrosion resistance than other metals in normal atmosphere. SUS has a chromium oxide-based passive layer at the surface. This passive layer isolates the base metal (SUS base) from the external environment. Thus, SUS exhibits high corrosion resistance. Even if the passive layer is destroyed by an oxidizing substance, such as chlorine ion, SUS is self-repaired by Cr or Mo in the SUS. Accordingly, SUS is broadly used as a corrosion-resistant material.

Even though a SUS member is used in the corona charger of an electrophotographic apparatus, however, the above problem can occur.

This is probably because corrosive substances, such as ozone and NOx, are present around the corona charger in higher concentrations than in normal atmosphere.

When SUS is used under high-humidity conditions in which corrosive substances are present in high concentrations, rust or other corrosion is liable to occur faster than the self-repair of the SUS. Cr and other metal atoms in the passive layer destroyed by oxidizing substances, such as ozone and NOx, react with the oxidizing substances to produce discharge products before repairing the passive layer.

In electrophotographic apparatuses, extremely larger amount of oxidizing substances is ionized than in normal atmosphere. In addition, in a high-humidity atmosphere, ozone is dissolved in water in the air to produce free radicals (OH). The free radicals rapidly react with organic and inorganic substances to oxidize the Cr and other metal atoms in the SUS (indirect oxidation by ozone). Consequently, current is likely to flow locally into the portion not coated with the passive layer, where the base metal (SUS base) is not protected, and thus corrosion can easily occur.

In order to solve this problem, Japanese Patent Laid-Open Nos. 11-40316, 2006-113531, and 2007-256397 disclose that the base metal of the plate grid is plated with a rust-preventing material, such as gold.

Even if the base metal of the plate grid is plated, however, the environment in electrophotographic apparatuses may cause the metal of the plate grid to corrode from a pin hole in the plating. While pin holes can be reduced by increasing the purity of the plating, or increasing the thickness of the plating, it is impossible to completely eliminate pin holes. Thus, the corrosion of the plate grid may not be prevented in some cases.

If a pin hole is formed in the plating, air in normal living environment containing oxygen, nitrogen, sulfur, chlorine, nitrogen oxides, carbon dioxide, sodium chloride, and so forth penetrates through the pin hole to produce a local cell, thus corroding the base metal of the plate grid. Also, a potential difference occurs between the plating metal and the base metal to produce a local cell, thus corroding the plate grid. Furthermore, plating considerably increases the cost depending on the plating metal.

SUMMARY OF THE INVENTION

Accordingly, the present invention provides a corona charger that prevents the corrosion of the plate grid and the occurrence of defective images resulting from nonuniform charging, and an electrophotographic apparatus including the corona charger.

According to an aspect of the invention, a corona charger for charging an image bearing member by corona discharge is provided. The corona charger includes a charging wire and a plate grid to which a voltage is applied to control the charged potential of the image bearing member. The plate grid is disposed between the charging wire and the image bearing member, and has a plurality of through-holes. The plate grid comprises a stainless steel base and a surface layer formed of tetrahedral amorphous carbon on the base.

According to another aspect of the invention, an electrophotographic apparatus including the corona charger is provided.

Further features of the present invention will become apparent from the following description of exemplary embodiments with reference to the attached drawings.

DESCRIPTION OF THE EMBODIMENTS

The present invention will be further described in detail with reference an embodiment.

General Structure of Electrophotographic Apparatus

Figure 1:
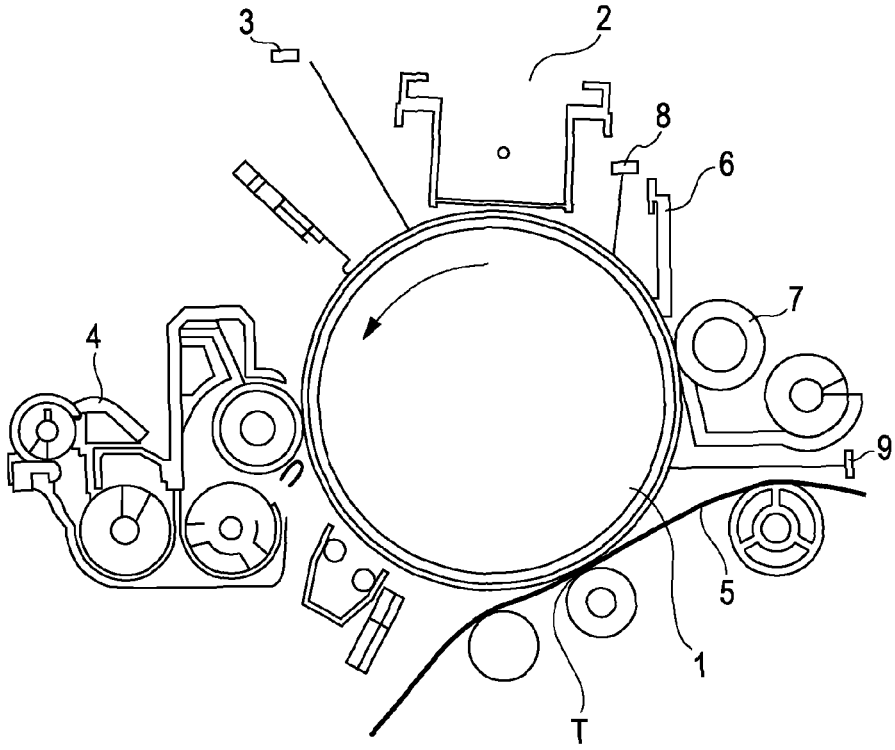
FIG. 1 is a schematic structural view of an electrophotographic apparatus according to an embodiment of the invention.

FIG. 1 shows a schematic structural view of an electrophotographic apparatus according to an embodiment of the invention.

The electrophotographic apparatus shown in FIG. 1 includes an image bearing member (electrophotographic photosensitive member) 1 and a corona charger (charging means) 2. The image bearing member 1 rotates in the direction indicated by an arrow, and the corona charger 2 charges a surface of the image bearing member 1 to a predetermined potential. An exposure unit (information writing means) 3 emits exposure light according to image information to the surface of the image bearing member 1, thus forming an electrostatic latent image on the surface of the image bearing member 1. Then a toner (developer) is deposited onto the electrostatic latent image from a developing unit (developing means) 4 and, thus, a toner image (developer image) is formed on the surface of the image bearing member 1. The toner image formed on the surface of the image bearing member 1 is transferred to a transfer material by a transfer unit (transfer means) 5. The toner image is fixed to the transfer material by a fixing device (fixing means) (not shown). The toner (untransferred toner) remaining on the surface of the image bearing member 1 without being transferred is removed and collected by a cleaner (cleaning means). The cleaner includes a cleaning blade 6, pressed on the image bearing member 1, and a fur brush 7. The untransferred toner is scraped off the surface of the image bearing member 1 by the blade and brush and collected into a toner container. The electrophotographic apparatus shown in FIG. 1 further includes a pre-charge exposure device 8 and pre-cleaning exposure device 9 to remove the potential remaining at the surface of the image bearing member 1.

Components of the electrophotographic apparatus shown in FIG. 1 will be described below.

Image Bearing Member

The image bearing member 1 of the electrophotographic apparatus shown in FIG. 1 is an electrophotographic photosensitive member of a rotational drum type (diameter: 84 mm) having a negatively chargeable organic optical semiconductor photosensitive layer. This image bearing member 1 is rotated on a central spindle (not shown) in the direction designated by the arrow at a process speed of, for example, 285 mm/s in the electrophotographic apparatus.

Corona Charger 2

Figure 2:
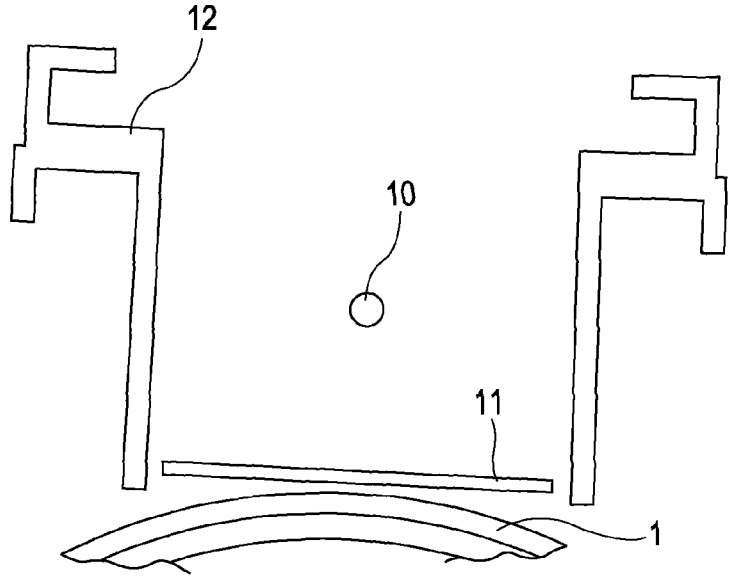
FIG. 2 is a schematic structural view of a corona charger of the electrophotographic apparatus.

FIG. 2 is a schematic structural view of a corona charger of the electrophotographic apparatus. A charging wire 10 is connected to an external power supply (not shown). On applying a bias voltage to the charging wire 10, corona discharge occurs to charge the surface of the image bearing member 1. The charging wire 10 can be made of stainless steel (SUS), nickel, molybdenum, tungsten, or the like. In an embodiment, the charging wire 10 is made of tungsten, which is particularly stable among metals. A tungsten charging wire 10 allows stable corona discharge over a long term.

The charging wire 10 is stretched at a specific tension between supporting blocks disposed at both ends in the longitudinal direction of a shielding case (supporting enclosure) 12 for electrical shielding. The supporting blocks are made of an insulating material, so that the charging wire 10 is electrically isolated from the shielding case 12.

The charging wire 10 can have a diameter of 40 to 100 μm. A charging wire having an excessively small diameter may be broken by ion collision caused by discharge. In contrast, a charging wire having an excessively large diameter requires a high voltage to be applied for stable corona discharge. If a high voltage is applied to the charging wire 10, ozone is easily produced and the power supply cost tends to increase.

In the embodiment, a tungsten wire having a diameter of 60 μm is used as the charging wire 10. The grid bias applied to the plate grid 11 connected to a constant-voltage power supply (not shown) is controlled according to the electrical charge produced by the corona discharge of the charging wire 10, so that the amount of electric charge applied to the image bearing member 1 is adjusted to control the charged potential of the image bearing member 1.

Figure 3:
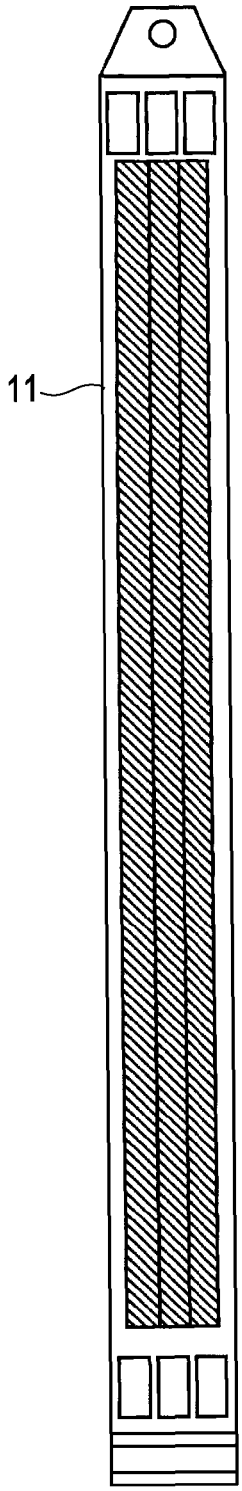
FIG. 3 is a schematic diagram of a plate grid of the corona charger.

FIG. 3 is a schematic diagram of the plate grid 11 of the corona charger shown in FIG. 2.

The plate grid 11 has a plurality of through-holes passing from the surface opposing the image bearing member 1 to the surface opposing the charging wire 10, thus being porous. The plate grid 11 is disposed at the open side of the shielding case 12, close to the surface of the image bearing member 1.

The plate grid simply mentioned herein is a mesh having through-holes as shown in FIG. 3.

Figure 4:
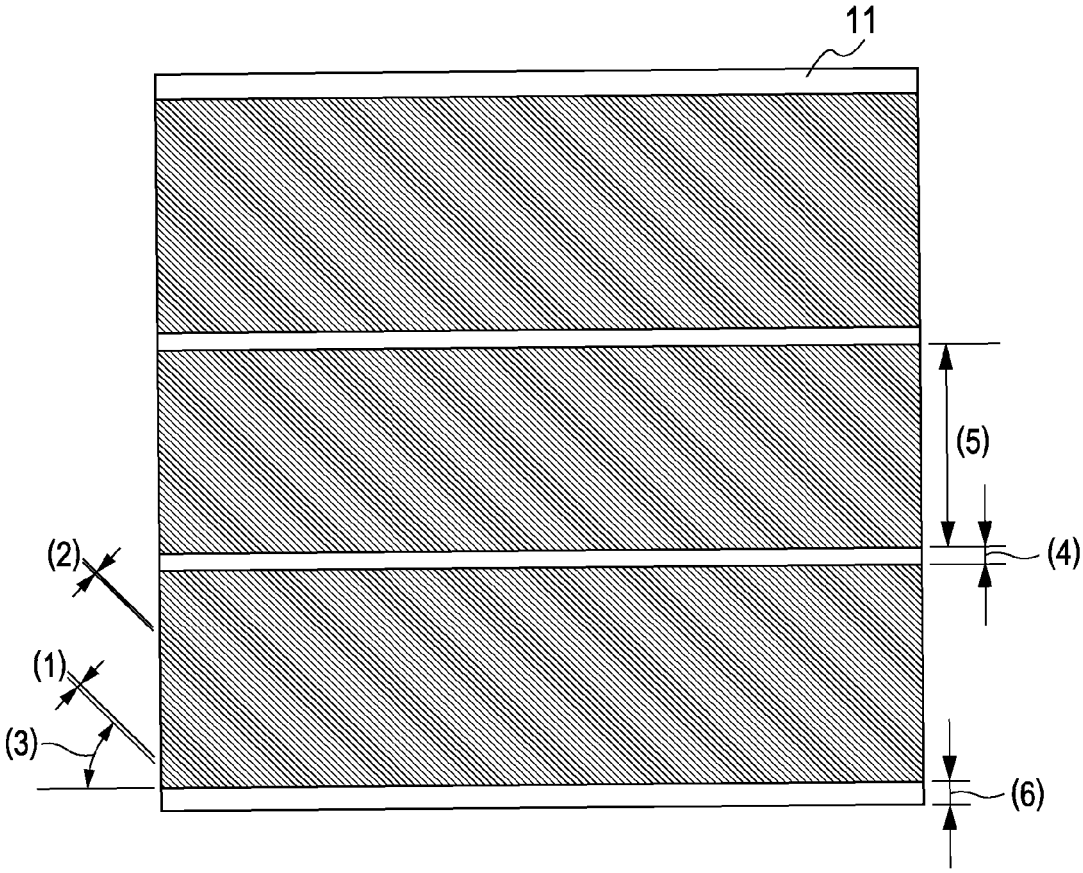
FIG. 4 is a fragmentary enlarged view of the plate grid.

FIG. 4 is a fragmentary enlarged view of the plate grid 11. The mesh of the plate grid 11 will now be described with reference to FIG. 4.

In the present embodiment, a 0.03 mm thick austenitic stainless steel (SUS304) sheet is used as the base metal of the plate grid 11, and a plurality of through-holes are formed in the sheet by etching. The etched sheet, that is the resulting plate grid 11, is in a form of mesh as shown in FIG. 4. The through-holes of the mesh extend at an angle of 45±1° with respect to the base line ((3) in FIG. 4) and at intervals of 0.071±0.03 mm ((2) in FIG. 4), and each have a width (opening width) of 0.312±0.03 mm ((1) in FIG. 4). The plate grid 11 is provided with beams having a width of 0.1±0.03 mm ((4) in FIG. 4) at intervals of 6.9±0.1 mm ((5) in FIG. 4) to prevent the bending of the plate grid 11. The plate grid 11 also has a frame having a width of 1.5±0.1 mm ((6) in FIG. 4).

The SUS base of the plate grid 11 is covered with a surface layer of tetrahedral amorphous carbon (hereinafter referred to as ta-C). ta-C is chemically inert to products of corona discharge. In the following description, the base metal made of SUS may be referred to as the SUS base and the surface layer of ta-C may be referred to as the ta-C layer.

Figure 5:
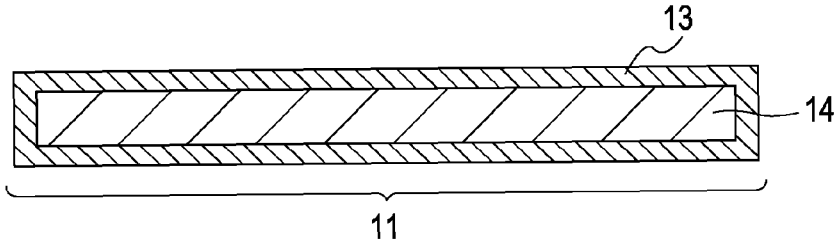
FIG. 5 is a schematic sectional view of the plate grid.

FIG. 5 is a schematic sectional view of the plate grid 11. Since a ta-C layer 13 is formed over the SUS base 14 of the plate grid 11, the SUS base 14 can be prevented from absorbing moisture to oxidize and electrolytically corrode even in a high-temperature, high-humidity atmosphere. Consequently, a uniformly and stably charged state can be maintained over a long term.

The base metal is not limited to the above-described austenitic stainless steel (SUS304) sheet, and other types of austenitic stainless steel may be used. Also, other stainless steel may be used, such as martensitic stainless steel or ferritic stainless steel.

ta-C will now be described.

The ta-C forming the surface layer of the plate grid is a type of diamond-like carbon (DLC). DLC generally has an amorphous structure in which diamond bonds (sp3 bonds) containing a small amount of hydrogen and graphite bonds (sp2 bonds) coexist.

Figure 6:
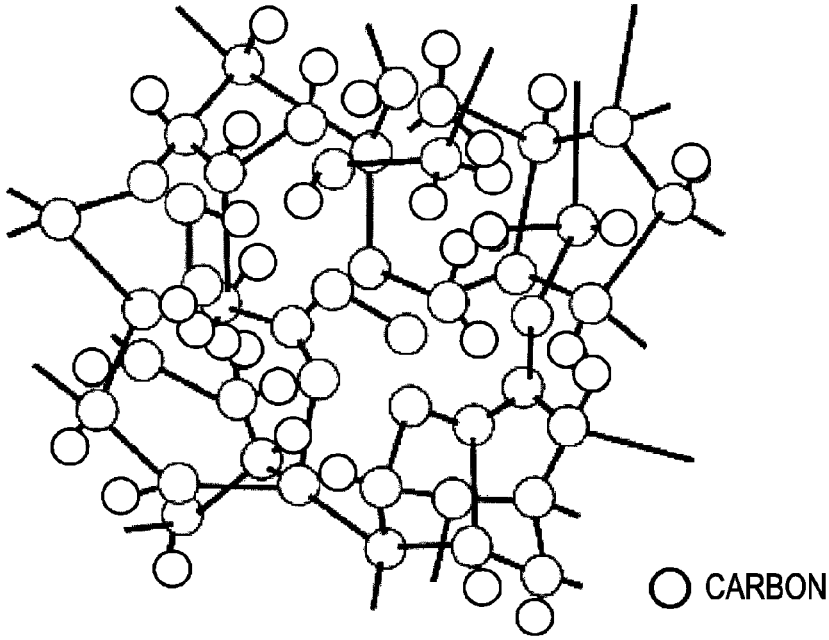
FIG. 6 is a schematic structural view of tetrahedral amorphous carbon (ta-c).

FIG. 6 is a schematic structural view of ta-C. In FIG. 6, white circles represent carbon atoms and bars (–) represent a bond. ta-C has a three-dimensional structure that is microscopically a tetrahedral crystal structure and macroscopically an amorphous structure.

ta-C includes sp3 bonds being diamond bonds and sp2 bonds being graphite bonds. More specifically, ta-C includes diamond bonds (sp3 bonds) sensitive to hardness and graphite bonds (sp2 bonds) sensitive to sliding properties. Accordingly, the frictional and wear property of ta-C varies depending on the proportions of the sp3 and sp2 bonds. The difference between the sp3 bond and the sp2 bond means the difference in valence state orbital in the valence-bond method.

Consequently, ta-C is inert to air and water at room temperature and superior in corrosion resistance, wear resistance, self-lubricity, hardness, and surface smoothness. Accordingly, ta-C is widely used as wear-resistant protective films of cutting tools and sliding parts.

Carbon can have four covalent bonds and form several allotropes depending on the bonding state. Sp3 hybrid orbitals form a three-dimensional crystal structure and result in a diamond structure (sp3 structure) shown in FIG. 7. Sp2 hybrid orbitals form a hexagonal plane structure and result in a graphite structure (sp2 structure) shown in FIG. 9.

The sp3 hybrid orbital is a combination of a single s orbital and three p orbitals, and four hybrid orbitals are formulated with wave functions ψn and expressed by the following equations (1-1) to (1-4).

Figure 7:
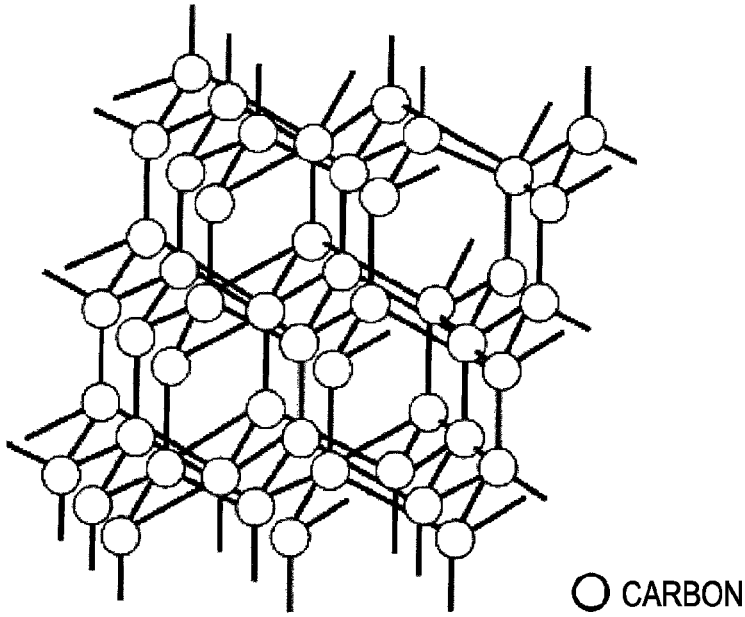
FIG. 7 is a schematic structural view of diamond.

FIG. 7 shows the crystal structure of general diamond. In the diamond crystal structure, when a carbon (white circle) is present at the center of a tetrahedron, the nearest carbon atoms are present on the vertexes of the tetrahedron and the carbon atoms are bound by covalent bonds with a bond length of 0.154 nm (1.54 Å).

Figure 8:
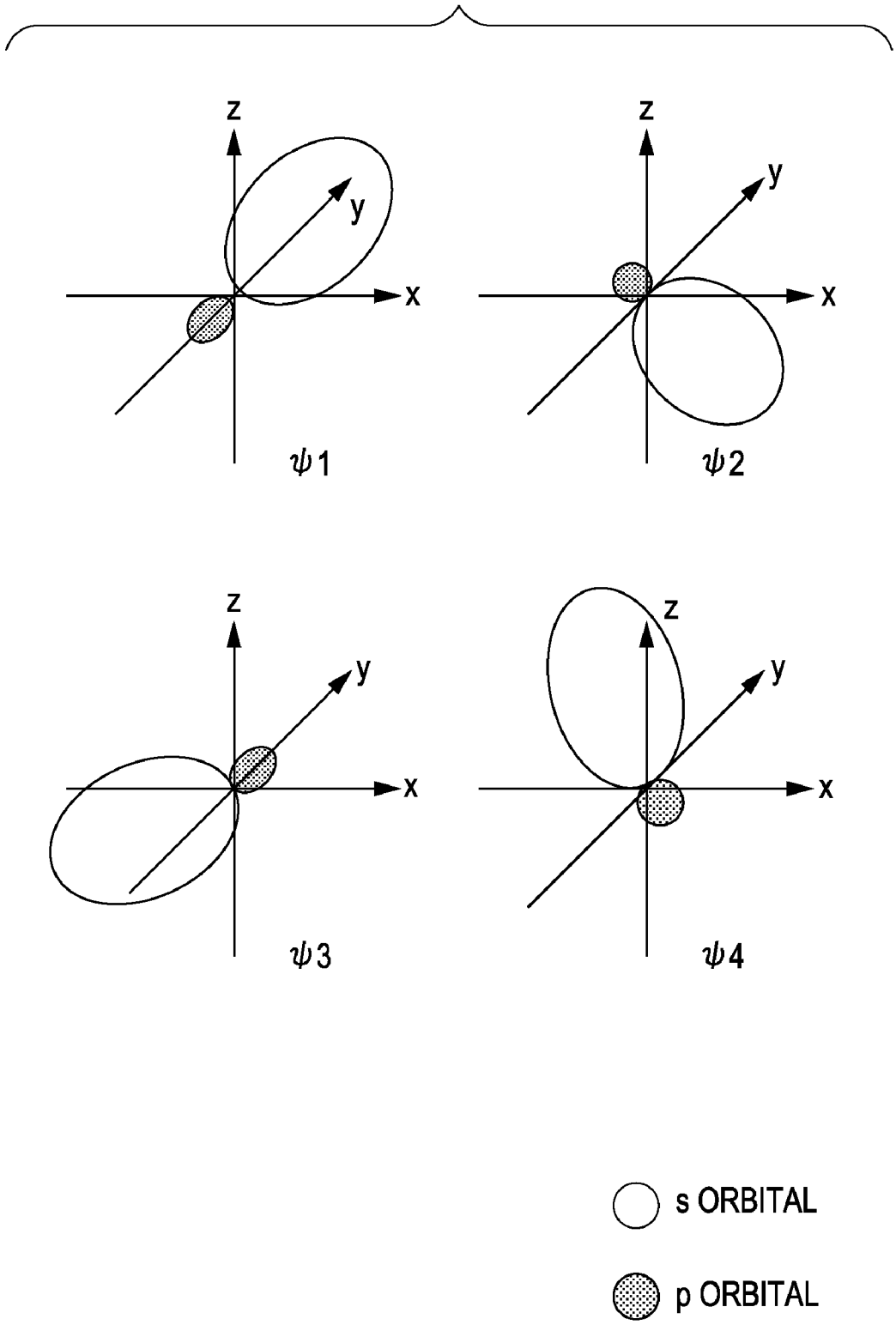
FIG. 8 is a representation showing four sp3 hybrid orbitals of carbon.

FIG. 8 shows four carbon sp3 hybrid orbitals. The gray portions are the p orbital and the others are s orbitals.

$$\Psi_1 = \frac{1}{2}(\Psi_{2s} + \Psi_{2px} + \Psi_{2py} + \Psi_{2pz}) \tag{1-1}$$

$$\Psi_2 = \frac{1}{2}(\Psi_{2s} + \Psi_{2px} - \Psi_{2py} - \Psi_{2pz}) \tag{1-2}$$

$$\Psi_3 = \frac{1}{2}(\Psi_{2s} - \Psi_{2px} + \Psi_{2py} - \Psi_{2pz}) \tag{1-3}$$

$$\Psi_4 = \frac{1}{2}(\Psi_{2s} - \Psi_{2px} - \Psi_{2py} + \Psi_{2pz}) \tag{1-4}$$

The sp2 hybrid orbital is a combination of a single s orbital and two p orbitals, and three hybrid orbitals are formulated as the following equations (2-1) to (2-3).

Figure 9:
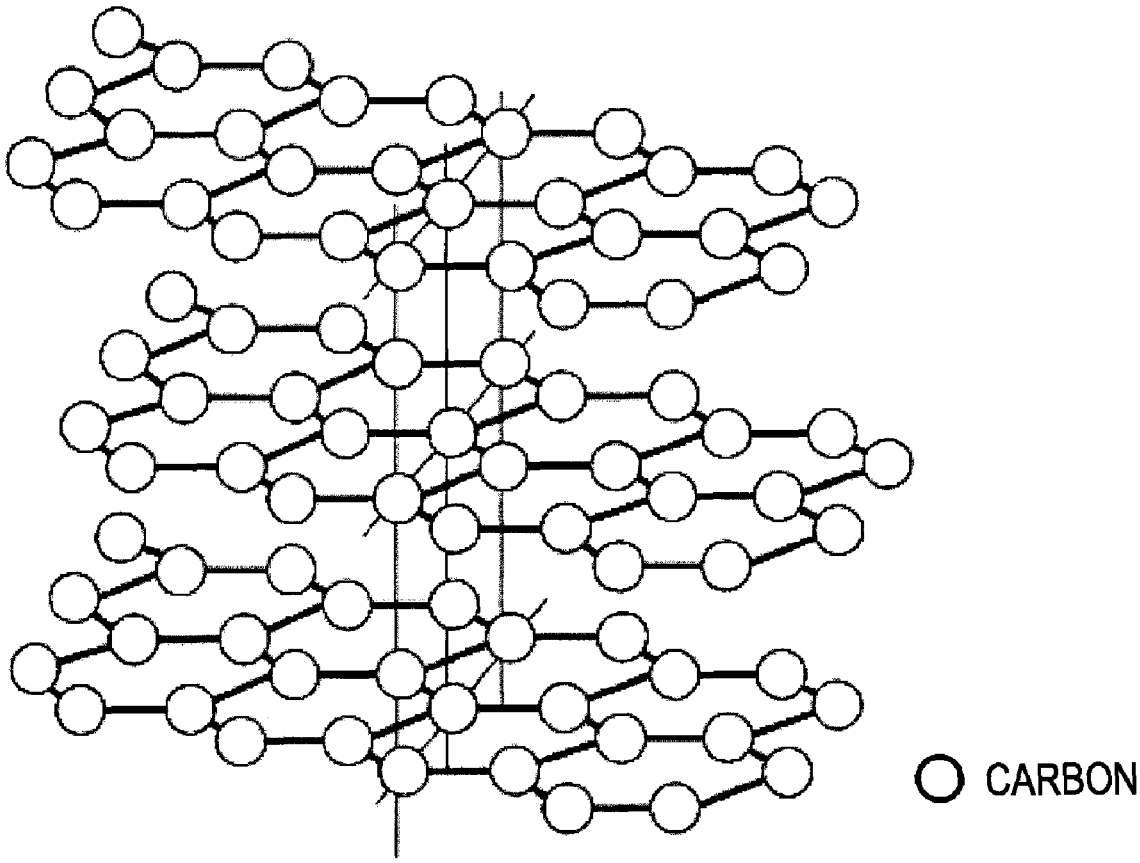
FIG. 9 is a representation of the crystal structure of general graphite.

FIG. 9 shows the crystal structure of general graphite. The graphite crystal has a layered hexagonal structure, and the carbon atoms are bound by covalent bonds in layers and by Van der Waals force between layers.

Figure 10:
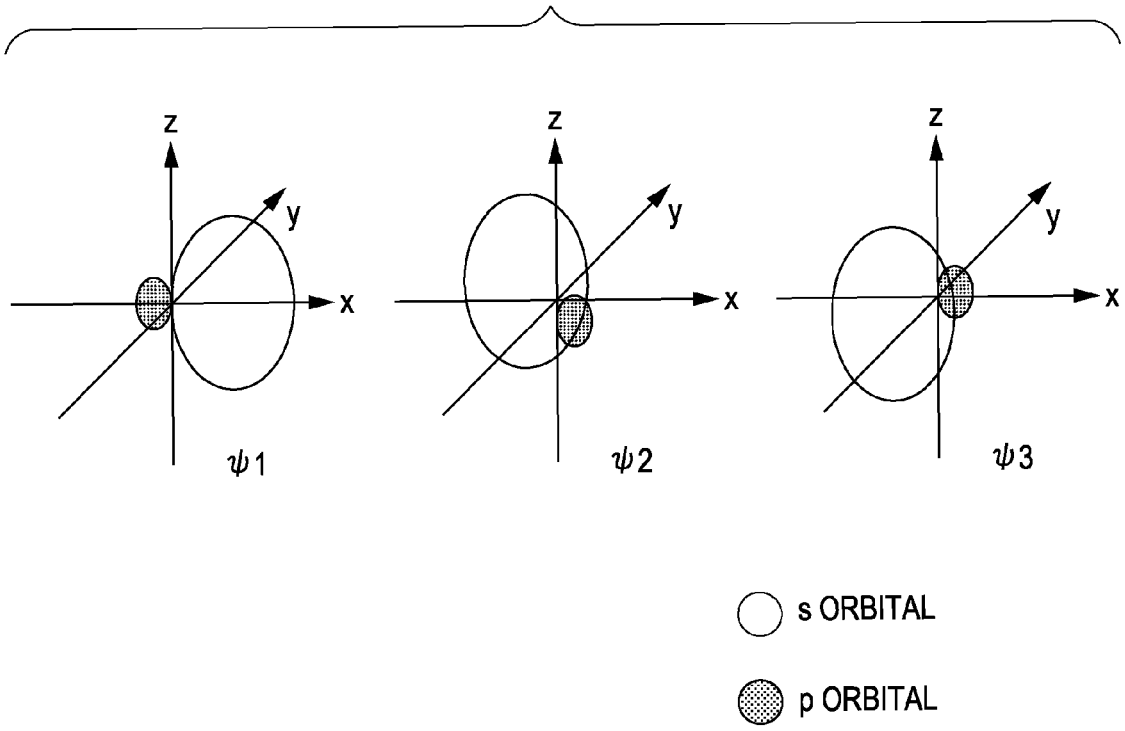
FIG. 10 is a representation of three sp2 hybrid orbitals of carbon.

FIG. 10 shows three carbon sp2 hybrid orbitals. The gray portions are the p orbital and the others are s orbitals.

$$\Psi_1 = \sqrt{\frac{1}{3}}\,\Psi_{2s} + \sqrt{\frac{2}{3}}\,\Psi_{2px} \tag{2-1}$$

$$\Psi_2 = \sqrt{\frac{1}{3}}\,\Psi_{2s} - \sqrt{\frac{1}{6}}\,\Psi_{2px} + \sqrt{\frac{1}{2}}\,\Psi_{2py} \tag{2-2}$$

$$\Psi_3 = \sqrt{\frac{1}{3}}\,\Psi_{2s} - \sqrt{\frac{1}{6}}\,\Psi_{2px} - \sqrt{\frac{1}{2}}\,\Psi_{2py} \tag{2-3}$$

ta-C does not easily cause chemical absorption or oxidation reaction, and is thus resistant to partial functional degradation resulting from the occurrence of abrasion or flaw.

In the present embodiment, the ta-C layer is formed by FCVA (filtered cathodic vacuum arc technology). More specifically, carbon plasma is generated from by graphite vacuum ark discharge, and ionized carbon is extracted and deposited to form the ta-C layer.

As an alternative to FCVA, PVD (physical vapor deposition) or CVD (chemical vapor deposition) may be applied to form the ta-C layer.

The volume resistivity, the thickness, and the surface smoothness of the ta-C layer formed on the SUS base may be adjusted so that the ta-C layer can exhibit high corrosion resistance without reducing the chargeability.

The ta-C layer has a medium volume resistivity suitable for a charger. More specifically, the ta-C layer can have a volume resistivity of $10^7$ to $10^9$ Ω·cm, and further $10^8$ to $10^9$ Ω·cm. In the present embodiment, the volume resistivity is adjusted in the range of $10^8$ to $10^9$ Ω·cm.

The ta-C layer can have such a thickness as deposition failure does not occur at the edge of the mesh. Deposition failure at the edge causes a corrosion current to concentrate on the edge and thus allows ozone products to adhere to the edge. Consequently, the percentage of openings of the mesh is reduced to cause nonuniform charging, or unevenness in density in output images. Accordingly, the thickness of the ta-C layer is preferably 0.1 μm or more. A ta-C layer thickness of 0.1 μm or more can be uniform easily and can prevent the occurrence of deposition failure at the edge.

However, a thickness of more than 10 μm increases the deposition time because the thickness of the ta-C layer correlates with the deposition time of the ta-C layer. A long-time deposition increases the tact time of the deposition step. Accordingly, the thickness of the ta-C layer is preferably about several micrometers (less than 10 μm).

As the surface roughness of the ta-C layer is increased, the surface area of the ta-C layer increases. As the surface area of the ta-C layer is increased, discharge products and aerosol more easily adhere to the surface of the ta-C layer. The discharge products and aerosol attached on the surface of the ta-C layer, which do not directly corrode the SUS base of the plate grid 11, may produce defective images. Therefore, the surface of the ta-C layer is desirably smoothed.

The surface roughness of the ta-C layer coating the SUS base is affected by the surface roughness of the underlying SUS base. The surface roughness of the ta-C layer is preferably adjusted to 1.0 μm or less, more preferably 0.5 μm or less, and still more preferably 0.3 μm or less, in terms of arithmetic mean deviation Ra defined in JIS B 0601-2001.

In order to maintain such smoothness of the ta-C layer, the surface roughness of the SUS base can be adjusted to 1.0 μm or less, preferably 0.5 μm or less, and more preferably 0.3 μm or less, in terms of arithmetic mean deviation Ra.

For optimizing the deposition conditions of the ta-C layer, the deposition can be performed at a temperature in the range of 0 to 80° C., preferably 40 to 80° C. In the present embodiment, the ta-C layer is formed at a temperature in the range of 40 to 80° C. In an example of the embodiment, the deposition speed was set at 1.5 nm/s and the resulting ta-C layer had a thickness of 1.0 μm and a surface roughness of 1.0 μm or less in terms of arithmetic mean deviation Ra.

Exposure Unit 3

A semiconductor laser beam scanner may be used as the exposure unit 3.

Developing Unit 4

The developing unit 4 may a reversal type using a two-component magnetic brush developing method.

The developing unit 4 includes a developing container and a developing sleeve. The developing container contains a two-component developer containing a toner and a magnetic carrier. The magnetic carrier may have a resistance of $5\times10^8$ Ω·cm and a mean particle size of 35 μm.

The toner is negatively charged by rubbing with the magnetic carrier. The developing sleeve closely opposes the image bearing member 1 with a closest distance (S-D gap) of 250 μm. The opposing region between the image bearing member 1 and the developing sleeve acts as a developing portion.

The developing sleeve is rotationally driven in such a manner that the surface of the developing sleeve is moved in the direction opposite to the movement of the surface of the image bearing member 1 at the developing portion. Hence, the developing sleeve is rotated in the same direction as the rotation direction (counterclockwise) of the image bearing member 1 designated by the arrow in FIG. 1. The developing sleeve includes a magnet roller inside. The two-component developer is delivered to the developing portion by the magnetic force of the magnet roller produced by the rotation of the developing sleeve.

A magnetic brush layer is formed to a predetermined small thickness by a developer coating blade (not shown), and a predetermined developing bias is applied to the developing sleeve from a developing bias power source. For example, an oscillatory voltage produced by superimposing a direct voltage (Vdc) of −650 V and an alternating voltage (Vac) having a peak-to-peak voltage of 1800 V may be applied to the developing sleeve as the developing bias.

An electric field produced by the developing bias selectively allows the toner contained in the two-component developer to adhere to an electrostatic latent image formed on the surface of the image bearing member 1. Thus, the electrostatic latent image is developed to form a toner image. The amount of electric charge applied to the toner may be −30 μC/g.

The developer on the developing sleeve through the developing portion is returned to a developer pool of the developing container by the rotation of the developing sleeve.

Transfer Unit 5

The transfer unit 5 may include a transfer roller and an intermediate transfer belt. Hence, the intermediate transfer apparatus may be used as the transfer unit 5.

The transfer roller is pressed against the surface of the image bearing member 1 with the intermediate transfer belt therebetween at a predetermined pressing force, and the nip portion acts as a transfer portion (primary transfer portion) T.

The intermediate transfer belt is held and transported between the image bearing member 1 and the transfer roller. A positive transfer bias (for example, +2.0 kV), whose polarity is opposite to the normal charging polarity (negative) of the toner, is applied to the transfer roller from a transfer bias power source. By applying a transfer bias, the toner image on the surface of the image bearing member 1 is electrostatically transferred onto the surface of the intermediate transfer belt (primary transfer). The toner image on the surface of the intermediate transfer belt is further transferred onto a transported transfer material at a secondary transfer portion (not shown).

Cleaner

The cleaner may include a cleaning blade 6 and a fur brush 7. The cleaner also includes a toner collecting container in which untransferred toner scraped off the surface of the image bearing member 1 with the cleaning blade 6 and the fur brush 7 is collected. The cleaning blade 6 can be made of an elastic urethane rubber. The cleaning blade 6 is pressed against the surface of the image bearing member 1 at a predetermined pressing force, and removes the remaining untransferred toner that cannot be collected by the fur brush 7.

Charge Eliminating Unit

A charge eliminating unit may include a pre-charge exposure device (pre-exposure lamp) 8 and a pre-cleaning exposure device (pre-cleaning exposure lamp) 9. These two exposure devices reset the potential at the surface of the image bearing member 1 after the primary transfer of the toner image, thus preventing the occurrence of ghost images. An array of LED chips having a central wavelength of 660 nm manufactured by Stanley may be used as the pre-charge exposure device 8 and the pre-cleaning exposure device 9.

The pre-charge exposure device 8 and the pre-cleaning exposure device 9 are connected to a pre-charge exposure device driving circuit and a pre-cleaning exposure device driving circuit respectively as driving controllers. In the pre-charge exposure device driving circuit and the pre-cleaning exposure device driving circuit, the irradiation on/off timing, the output value (amount of light), and other conditions are controlled by an integrated information circuit acting as a controller.

Fuser

The transfer material onto which the toner image has been transferred at the secondary transfer portion (not shown) is transported to a fuser (not shown), and the toner image is fixed and output as an image material (print or copy). The fuser may be a heat roller fuser.

Conditions 1 of ta-C Layer Deposition

The proportions of the sp3 structure and the sp2 structure in the ta-C layer were varied to examine the conditions for depositing the ta-C layer.

Samples having sp3/sp2 ratios shown in Table 1 were prepared by FCVA, laser ablation, and radio frequency magnetron sputtering at a controlled substrate temperature, a controlled pulsed voltage, a controlled assist gas flow rate, and a controlled annealing temperature in an atmosphere of a selected gas. Laser ablation was performed according to the method disclosed in Japanese Patent Laid-Open No. 2005-15325, and radio frequency magnetron sputtering was performed according to the method described in Hyoumen Kagaku (Surface Science) Vol. 24, No. 7, pp. 411-416.

For evaluation of output images, the plate grid of the embodiment was installed to the corona charger 2 of a color copier manufactured by Canon (product name: image PRESS C1). The plate grid had a ta-C layer formed on the SUS base. The ta-C layer was formed to a thickness of 1 μm on the charging wire side (on the surface opposing the charging wire) and the side surfaces perpendicular to the charging wire side. The color copier acts as the electrophotographic apparatus shown in FIG. 1.

First, a total current of 1000 μA was supplied to the charging wire of the corona charger 2 while a grid bias of −800 V was applied to the grid. Thus, corona discharge was performed under high-temperature, high-humidity conditions (30° C., 80%) for 150 hours in total. Then, half-tone images were output for evaluation of the output images and the plate grid.

The output images were evaluated according to the following criteria by comparing the unevenness in density with that of the initial images. The plate grid was evaluated according to the following criteria by measuring the degree of corrosion. D used in the criteria for evaluating images represents the density of the half-tone image, and ΔD represents the difference between the highest density and the lowest density in the longitudinal direction of the image bearing member.

Table 1 shows the evaluation results of output images and the plate grids.

Criteria for Evaluating Output Images

A: no unevenness was observed; $\Delta D \leqq 0.05$

B: slight unevenness was observed; $0.05 \leqq \Delta D \leqq 0.2$

C: unevenness was observed; $0.2 \leqq \Delta D$

The evaluation becomes higher upward.

Criteria for Evaluating Degree of Corrosion

AAA: substantially no deposit was observed.

AA: slight local deposit was observed.

A: local deposit was observed.

B: local deposit and slight deposit was observed over the entirety.

C: deposit was observed over the entirety

The evaluation becomes higher upward. As foreign matter is deposited more locally or more slightly, the degree of corrosion is probably smaller.

The ratio of the sp3 structure to the sp2 structure was measured by transmission electron microscopy (TEM). More specifically, a plurality of portions of the deposited ta-C layer were mapped. The peaks of the π* and σ* maps were extracted by electron energy loss spectroscopy to examine the state of chemical bonds of carbon atoms in the ta-C layer. Thus, the rate of the sp3 structure to the sp2 structure was calculated.

Figure 11:
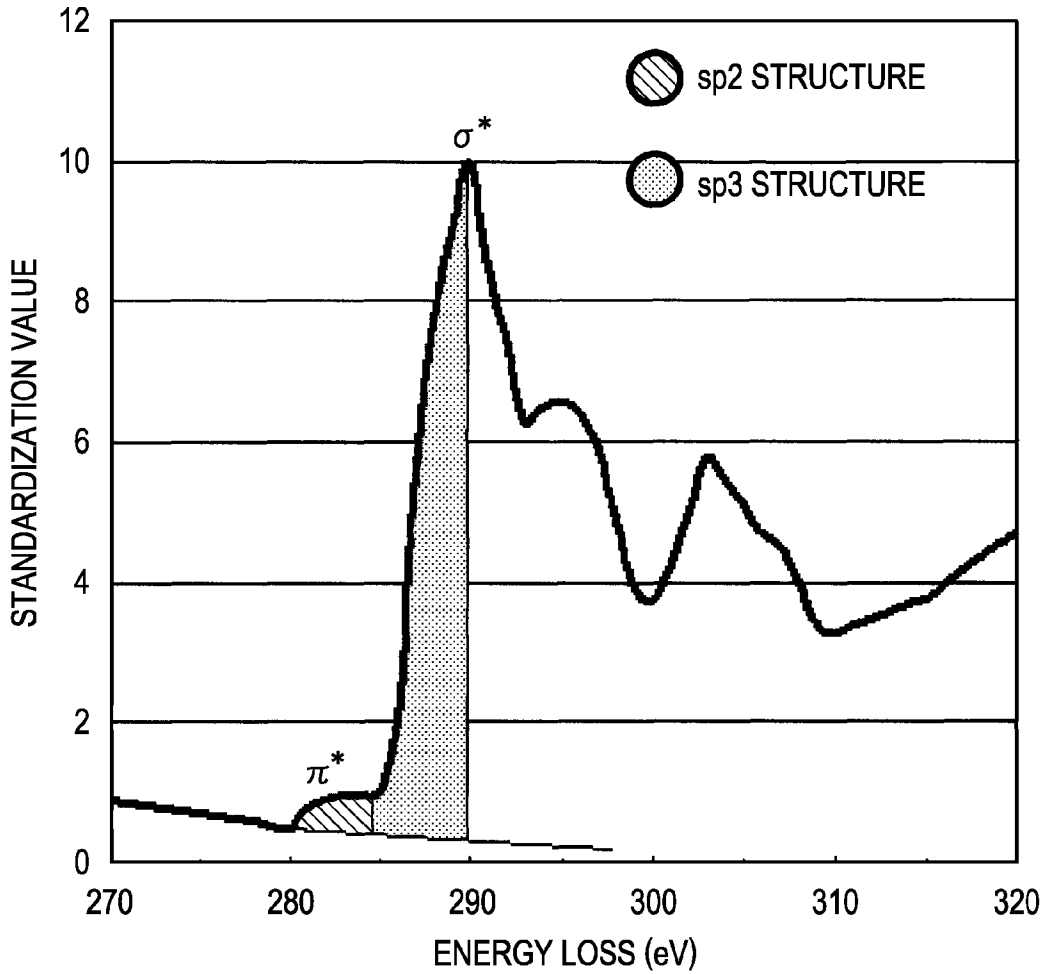
FIG. 11 is a representation showing the state of chemical bonds of a ta-C layer observed by electron energy loss spectroscopy.

FIG. 11 shows the state of the chemical bonds in the ta-C layer observed by electron energy loss spectroscopy. The diagonally shaded area represents the π* peak showing the sp2 structure, and the gray area represents the σ* peak showing the sp3 structure.

As shown in FIG. 11, it has been confirmed that the ta-C layer includes the sp3 structure and the sp2 structure. For measuring the proportions of the sp3 and sp2 structures, mapped images were output for the respective structures by mapping a plurality of portion of the π* peak of the ta-C layer, and subsequently mapping a plurality of portions of the σ* peak of the ta-C layer. Each image was binarized and the proportion of the white portion having a contrast equal to or more than a predetermined value was calculated. The ratios of the sp3 structure to the sp2 structure (sp3/sp2=1/9 to 9/1) are shown in Table 1.

TABLE 1

| | sp3/sp2 | | | | | | |
|---|---|---|---|---|---|---|---|
| | 9/1 | 7/3 | 6/4 | 5/5 | 4/6 | 3/7 | 1/9 |
| Image evaluation | A | A | A | A | B | B | B |
| Corrosion evaluation | AAA | AAA | AA | A | B | B | B |

Table 1 shows that compositions including the sp3 structure more than the sp2 structure result in higher evaluations of image quality and corrosion resistance. In particular, a composition having a sp3 structure/sp2 structure ratio of 6/4 or more, or further 7/3 or more, can produce superior results in image quality and corrosion resistance.

This is probably because a composition including a large amount of sp2 structure may result in clogged micro-holes between planar graphite layers. More specifically, other chemical substances, such as ozone, discharge products, and free radicals, are liable to be absorbed to clog the micro-holes. In addition, other factors (for example, contact corrosion) may affect the results.

On the other hand, it is believed that a composition including a large amount of sp3 structure from a closely packed nanostructure and prevents structural defects, thus reducing negative effects of other factors.

Conditions 2 of ta-C Layer Deposition

A ta-C layer including the sp3 structure and the sp2 structure in a ratio of 7/3 was formed on the SUS base of a plate grid. Thus, it was examined which surface the ta-C layer formed on was effective.

Three types of plate grid were prepared: one had a ta-C layer on both the charging wire side (surface opposing the charging wire) and the image bearing member side (surface opposing the image bearing member); another had a ta-C layer on only the charging wire side; and the other had a ta-C layer only on the image bearing member side. In any type of the three plate grids, the side surfaces perpendicular to the charging wire side and the image bearing member side surface were coated with the ta-C layer.

First, a total current of 1000 μA was supplied to the charging wire of the corona charger 2 while a grid bias of −800 V was applied to the grid. Thus, corona discharge was performed under high-temperature, high-humidity conditions (30° C., 80%) for 150 hours in total. Then, half-tone images were output for evaluation of the output images and the plate grid.

The output images were evaluated according to the above criteria by comparing the unevenness in density with that of the initial images. The plate grid was evaluated according to the above criteria by measuring the degree of corrosion.

Table 2 shows the evaluation results of output images and the plate grids.

When the ta-C layer was formed only on one side, the other side was not coated with the ta-C layer and the stainless steel (for example, SUS 304) of the base was exposed.

For comparison, a plate grid having a KN plating layer and a plate grid having no coating were prepared. The KN plating layer was formed to a thickness of 3 to 6 μm on the same base metal by ordinary electroless nickel plating.

TABLE 2

| | | Type | | | | |
|---|---|---|---|---|---|---|
| | | ta-C | | | KN plating | No coating |
| Deposition surface | | Both sides | One side (charging wire side) | One side (image bearing member side) | Both sides | |
| Image evaluation | | A | A | B | B | C |
| Corrosion evaluation | Charging wire side | AAA | AAA | C | C | C |
| | Image bearing member side | AAA | A | AAA | C | C |

In the plate grid in which the ta-C layer was formed only on the charging wire side, because of the anticorrosion effect of the ta-C layer, deposit or unevenness in density hardly occurred at the charging wire side, where the most serious corrosion could arise. The image bearing member side of the grid exhibited local deposit because the ta-C layer was not provided, but unevenness in density hardly occurred in the output images because the image bearing member side is less affected by ozone or the like than the charging wire side.

On the other hand, in the plate grid in which the ta-C layer was formed only on the image bearing member side, deposit hardly occurred on the image bearing member side because of the anti-corrosion effect of the ta-C layer. However, the charging wire side, where the most serious corrosion could arise, exhibited deposit over the entire surface because the ta-C layer was not provided, and unevenness in density occurred in the output images.

The ta-C layer is desirably formed on the SUS base on both the charging wire side and the image bearing member side. If the ta-C layer is formed only on one side, however, it is preferably formed on the charging wire side.

Opening Width of Through-holes

A ta-C layer including the sp3 structure and the sp2 structure in a ratio of 7/3 was formed on the SUS base of a plate grid, and the relationship between the opening width of the through-holes in the plate grid 11 and the quality of images was examined by varying the opening width of the through-holes. The opening width of the through-holes corresponds to (1) in FIG. 4. The ta-C layer was formed on both the charging wire side and the image bearing member side of the plate grid.

First, a total current of 1000 μA was supplied to the charging wire of the corona charger 2 while a grid bias of −800 V was applied to the grid. Thus, corona discharge was performed under high-temperature, high-humidity conditions (30° C., 80%) for 80 hours in total. Then, half-tone images were output for evaluation of the output images according to the same criteria as above.

Figure 12:
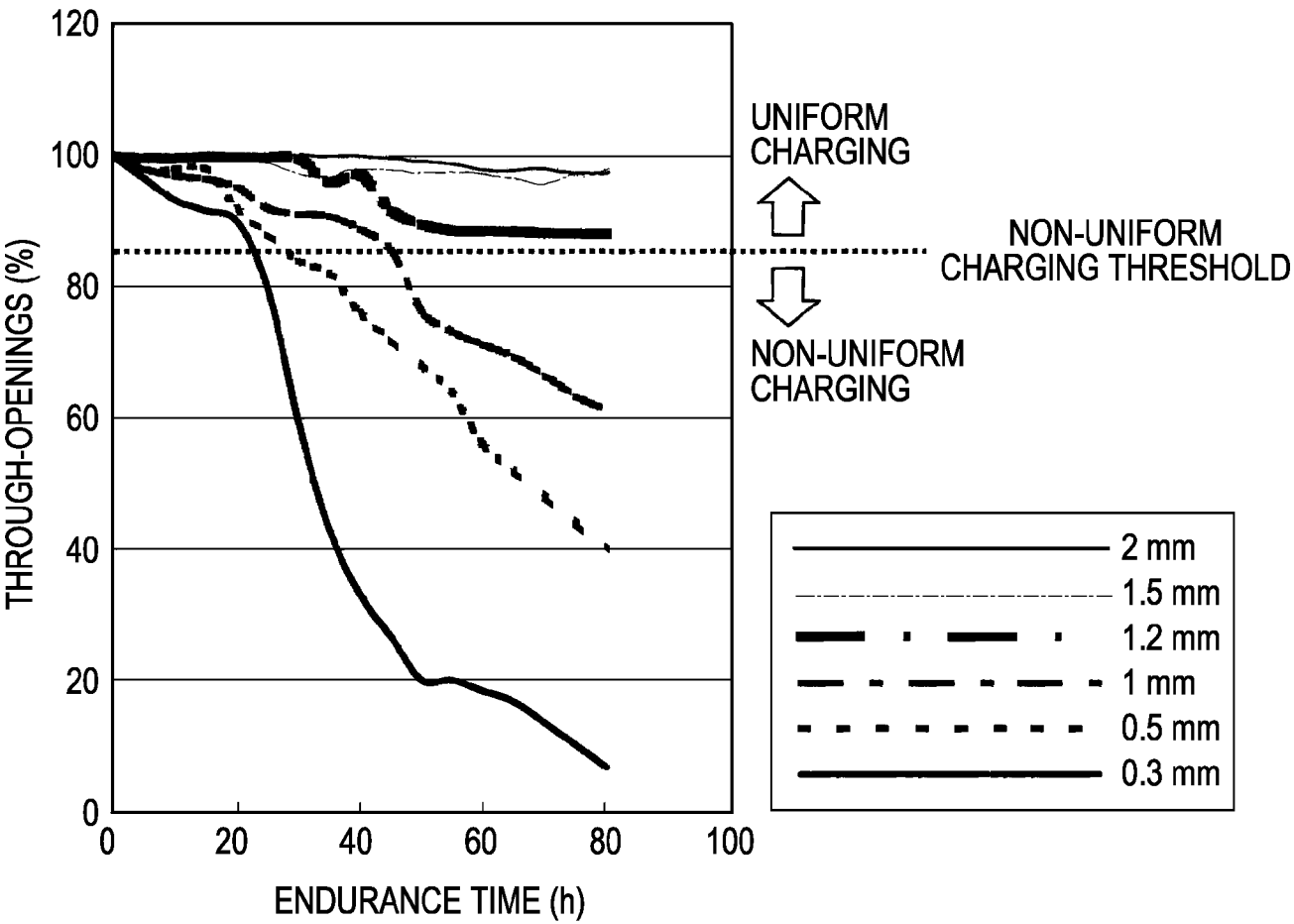
FIG. 12 is a plot showing the evaluation results of a known SUS plate grid having no ta-C layer.
Figure 13:
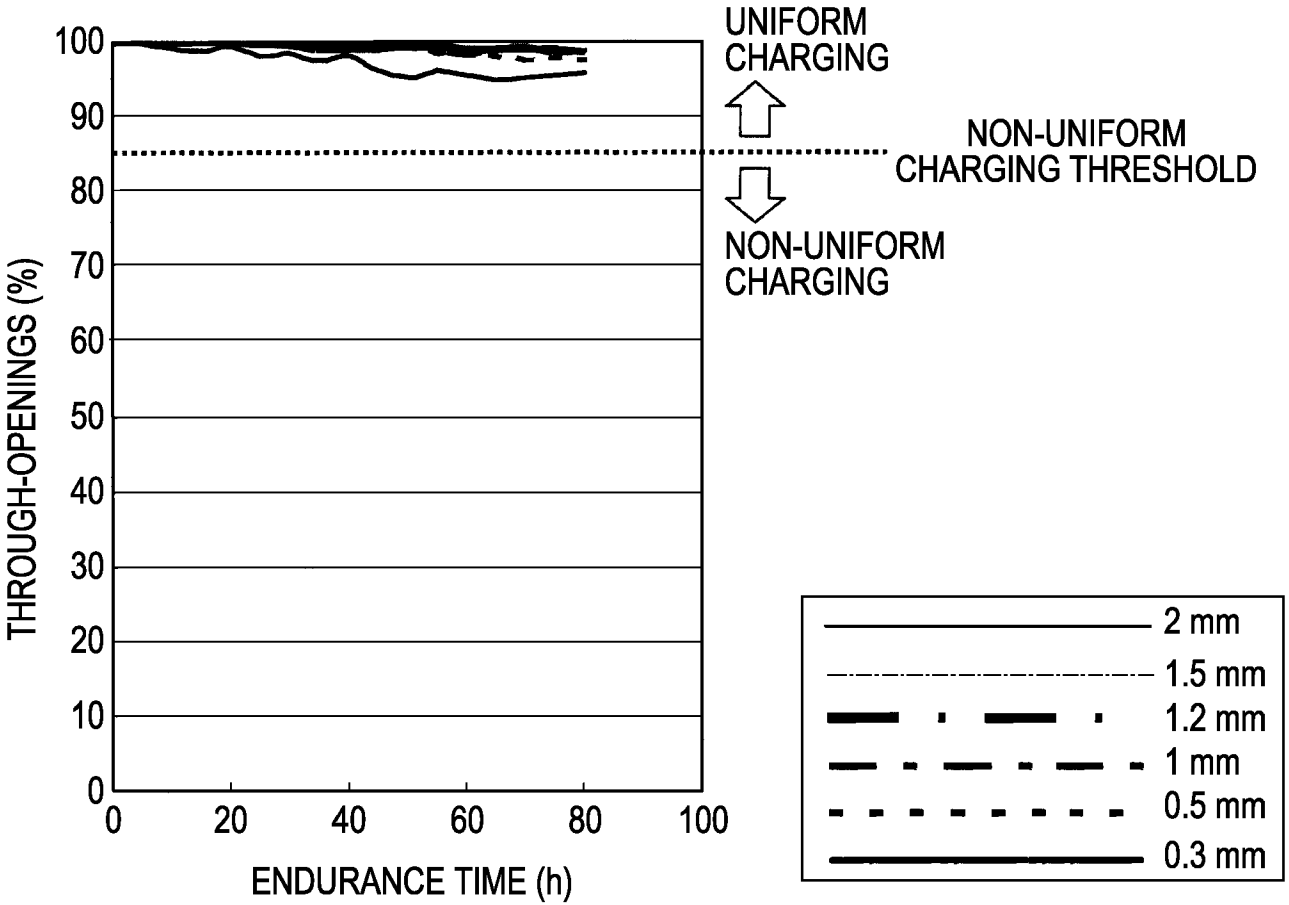
FIG. 13 is a plot of the evaluation results of a SUS plate grid prepared in an example of the invention.

FIG. 12 is a plot showing the evaluation results of a known SUS plate grid having no ta-C layer. FIG. 13 shows the results of evaluation using the plate grip according to the embodiment of the invention. In FIGS. 12 and 13, the lateral axis represents the endurance time (h) or the time for which corona discharge was performed, and the vertical axis represents the percentage of openings of the through-holes to the initial state. For the examination, six types of plate grid having through-holes with opening widths of 0.3 mm, 0.5 mm, 1 mm, 1.2 mm, 1.5 mm, and 2 mm were used.

As shown in FIG. 12, when the through-holes have an opening width of 0.3 to 1 mm, the percentage of openings is reduced with time; when the through-holes have an opening width of 1.2 mm or more, the percentage of openings is not reduced from a specific level and maintains the level. This is probably because air flow prevents the growth of discharge products, and because even if the discharge products are crystallized, the crystals are broken by their own weight.

It has also been found that until the percentage of openings is reduced to a specific level, favorable images can be formed without unevenness in density resulting from nonuniform charging.

On the other hand, when a plate grid having a ta-C layer was used, the percentage of openings was hardly reduced with time over the range of through-holes with of 0.3 to 2 mm, as shown in FIG. 13. Also, the results show that a grid having through-holes of 1 mm or less in opening width can produce a significant effect.

As the percentage of openings of the through-holes at the threshold of nonuniform charging, the value obtained in FIG. 12 is applied to FIG. 13.

It has been confirmed that a plate grid having a ta-C layer on both the charging wire side and the image bearing member side can greatly reduce the cause that reduces the opening width of the through-holes and prevent nonuniform charging.

Although the above embodiment uses the plate grid shown in FIG. 4, the grid is not limited to the form of the embodiment, and plate grids having different shapes can produce the same effect. For example, a plate grid having a honeycomb structure as disclosed in Japanese Patent Laid-Open No. 2005-338797 may be used.

As described above, the embodiment of the invention prevents discharge products from corroding the surface of the plate grid, and thus nonuniform charging resulting from the corrosion can be prevented. The present invention thus provides a corona charger that can form images without defects, and an electrophotographic apparatus including such a corona charger.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-112517 filed Apr. 23, 2008, which is hereby incorporated by reference herein in its entirety.

What is claimed is:

1. A corona charger, which is a non-contact charging member, for charging an image bearing member by corona discharge, the corona charger comprising:

a charging wire; and a plate grid to which a voltage is applied to control the charged potential of the image bearing member, the plate grid being disposed between the charging wire and the image bearing member, the plate grid comprising a stainless steel base and a surface layer formed of tetrahedral amorphous carbon on the base, and the plate grid having a plurality of through-holes, wherein the surface layer includes a carbon sp3 structure and a carbon sp2 structure, and a ratio of the carbon sp3 structure to the carbon sp2 structure in the surface layer is at least 6/4.

2. The corona charger according to 1, wherein the ratio is 7/3 or more.

3. The corona charger according to claim 1, wherein the surface layer is disposed on the charging wire side of the plate grid.

4. The corona charger according to claim 1, wherein the through-holes have an opening width of 1 mm or less.

5. An electrophotographic apparatus comprising:

an electrophotographic photosensitive member acting as an image bearing member; and a corona charger, which is a non-contact charging member, for charging the electrophotographic photosensitive member by corona discharge, wherein the corona charger comprises:

a charging wire; and a plate grid to which a voltage is applied to control the charged potential of the electrophotographic photosensitive member, the plate grid being disposed between the charging wire and the electrophotographic photosensitive member, the plate grid comprising a stainless steel base and a surface layer formed of tetrahedral amorphous carbon on the base, and the plate grid having a plurality of through-holes, wherein the surface layer includes a carbon sp3 structure and a carbon sp2 structure, and a ratio of the carbon sp3 structure to the carbon sp2 structure in the surface layer is at least 6/4.

* * * * *